United States Patent [19]

Piscetta

[11] 4,133,127

[45] Jan. 9, 1979

[54] SAFETY DEVICE FOR OBSOLETE CYLINDER FIREARMS

[76] Inventor: Armando Piscetta, 4, Via delle Fornaci, Loano, Italy

[21] Appl. No.: 853,576

[22] Filed: Nov. 21, 1977

[30] Foreign Application Priority Data

Jul. 26, 1977 [IT] Italy ..... 26115 A/77

[51] Int. Cl.[2] ..... F41C 17/08

[52] U.S. Cl. ..... 42/66

[58] Field of Search ..... 42/66, 65, 59

[56] References Cited

U.S. PATENT DOCUMENTS

| | | | |
|---|---|---|---|
| 165,098 | 6/1875 | Hopkins | 42/66 |
| 720,775 | 2/1903 | Beckwith | 42/66 |
| 3,748,771 | 7/1973 | Piscetta | 42/66 |
| 3,803,741 | 4/1974 | Ducommun | 42/66 |

*Primary Examiner*—Charles T. Jordan
*Attorney, Agent, or Firm*—Michael J. Striker

[57] ABSTRACT

In a typical XIX Century revolver of the type comprising a hammer and a cylinder supported for rotation about a shaft having a predetermined axial position in said frame, a cylinder shaft rearwardly projecting out through said frame and towards said hammer, said shaft and said hammer having an extension and respectively a recess not symmetrical relatively to the revolver symmetry plane, whereby when said shaft is rotated in a first rotational position the said extension abuts on a not recessed part of the hammer, the said hammer is prevented from reaching the firing position, and when the shaft is rotated in another rotational position wherein said extension freely enters in said recess the revolver can be fired.

5 Claims, 6 Drawing Figures

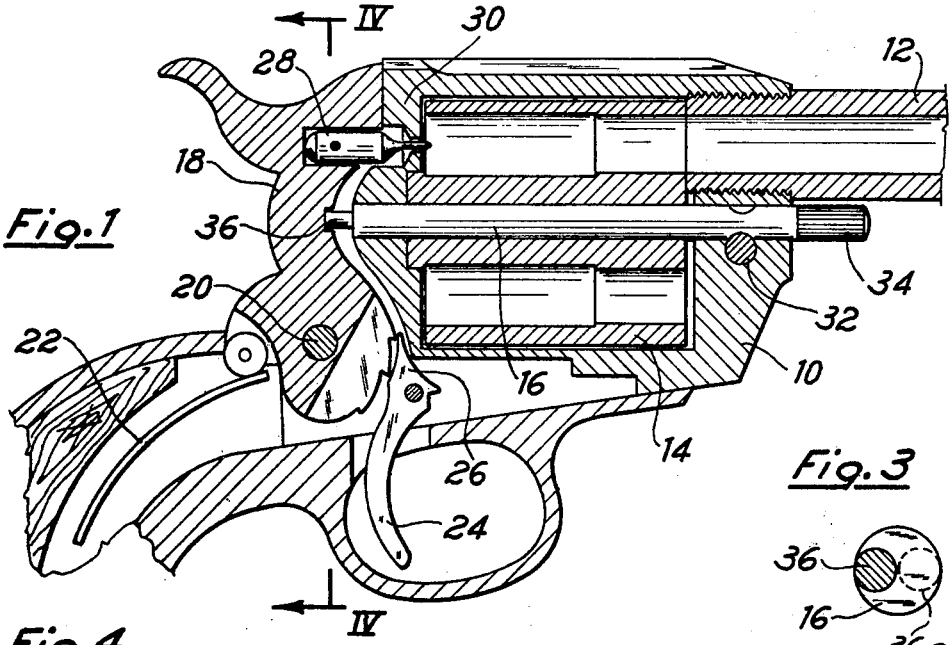
Fig.1
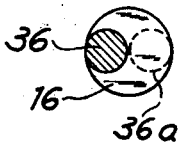
Fig.3
Fig.4
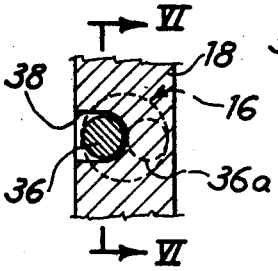
Fig.2
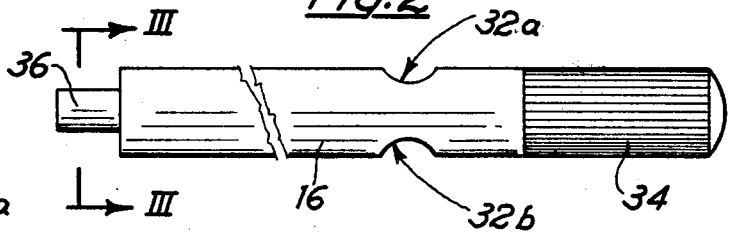
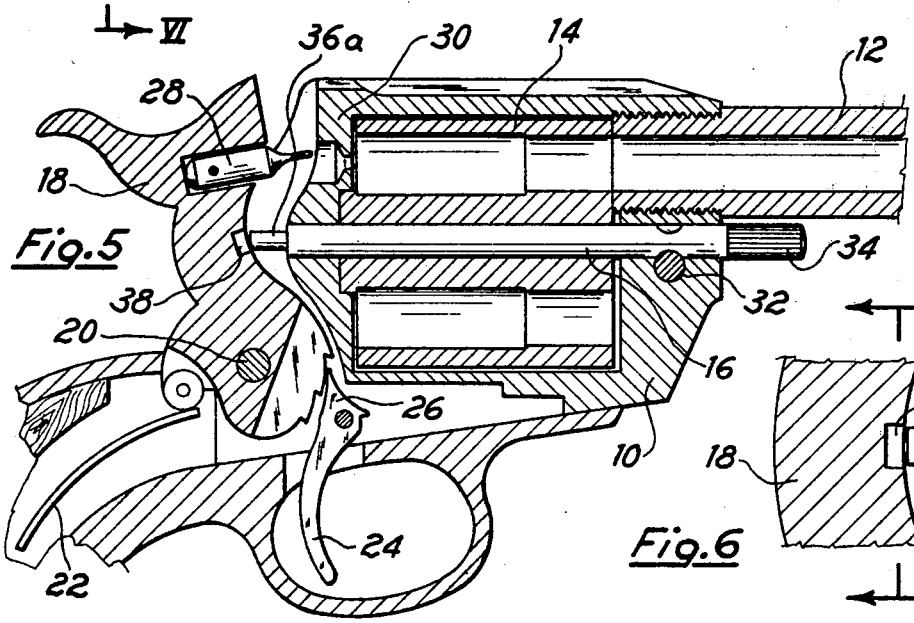
Fig.5
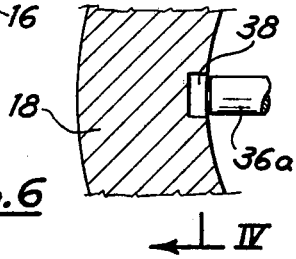
Fig.6

SAFETY DEVICE FOR OBSOLETE CYLINDER FIREARMS

BACKGROUND OF THE INVENTION

1. Field of the Invention

This invention is concerned with old type firearms, in particular with obsolete revolvers as devised and largedly manufactured in the second half of the XIX Century, such as "Frontier" and "Old Far West" revolvers, Colts, Smith & Wesson and so on, either restored or of new manufacture to accurately reproduce the original firearm, for actual firing of same.

2. Prior Art of the Invention

The interest and the historical value of such obsolete firearms is well known. Said revolvers form an important element of the history and legends of western countries. Such small arms are widely appreciated by collectors and also newly manufactured reproductions are in demand. Collectors and amateurs of said historical arms desire also to fire their arms and target competitions are being organized.

The ingenuity of structure and of mechanisms of such more than one century old revolvers is admirable, but such arms must be considered as rather unsafe, according to current modern standards.

A safety mechanism adapted for complementing the original safety system of such obsolete firearm has been described in my prior U.S. Pat. No. 3,748,771, issued on July, 31, 1973. Such improved safety machanism is arranged for preventing the firing pin, seated into the hammer, from reaching the position wherein it can strike on the cartridge primer, when the revolver is set at its half-cocked position.

There has been proposed also another safety device, described in the U.S. Pat. No. 3,803,741, issued on Apr. 16, 1974, comprising an axially and selectably movable cylinder shaft which, when positioned at a rearward hammer engaging axial position, prevents the full forward motion of same hammer, as required for firing.

The above referred known mechanisms operate upon the concept of making use of arrangements so as to prevent the firing pin or the complete hammer from reaching its primer striking position. This concept is sound. On the other part, this concept is generally applied by providing means for selectively securing a lengthwise movable element in a position on which it blocks the full forward motion of the firing pin or of the hammer. It is evident that if such movable element is subjected to follow the motion of the hammer (the inertia of which is relevant, in particular of a bulky hammer of an obsolete firearm) upon failing of the means provided for preventing the forward motion of some components, the wanted safety requirement will not be satisfied and the revolver will be unduly fired.

It is therefore an object of this invention to provide a firearm, namely an old type revolver of the character referred to above, with an improved safety mechanism which does not affect the external appearance of the arm and its firing ability, and which is not subject to the above and other objections, but is capable of providing the most complete and efficient safety and protection against accidental or undue firing even under most violent shocks and unaccurate handling of the revolver.

SUMMARY OF THE INVENTION

Referring now to the invention, the cylinder revolver comprises a cylinder conventionally mounted for rotation about the central portion of a shaft which has fore and rear portions mounted into the frame of the firearm. The terms "fore" and "rear" define, in this specification and in the appended claims, the portion nearer to the barrel and respectively to the hammer. Also conventionally, the hammer is in part external to the rear portion of the frame and it is adjacent to said frame portion when the firing pin strikes the primer of the cartridge co-axial with the barrel.

Still also conventionally, the various essential components of the firearm are arranged symmetrically to the firearm plane of symmetry wherein the axes of the barrel and of the cylinder lie.

According to the invention, the rear portion of the cylinder shaft has an extension jutting out from the rear portion of the frame, said extension being asymmetrical i.e., off-axis relatively to the axis of the cylinder shaft, and extending in such amount that a not modified hammer will abut on said extension, when moving towards the firing position, well before reaching such firing position; at its turn, the hammer is modified by providing it with a recess facing the revolver frame and so positioned that, upon rotationally positioning the cylinder axis in one given rotational position, the said extension will freely penetrate in said recess so that the hammer can perform its entire firing stroke, except if said shaft is rotated in another position, different from said given position, so that the shaft extension will abut on a not recessed part of the hammer, preventing said hammer from completing its stroke.

A critical feature of the invention consists in the fact that the cylinder shaft is arranged and rigidly secured in the revolver frame in one predetermined axial position, additionally in said given rotational position, whereby no risk of unduly accidental or unduly axial displacement of the cylinder shaft can occur (and consequent firing) even under the most violent shocks and most unaccurate handling of the revolver.

These and other features and advantages of the invention will be now made apparent from the following detailed description of a preferred embodiment of same invention, reference being made to the accompanying drawing, wherein only the parts, components and arrangement of interest for the invention have been illustrated and evidenced. While the revolver has been fragmentarily and diagrammatically shown, it is well known. A complete diagram is not necessary to show the characteristics of the invention.

THE VIEWS OF THE DRAWING

FIG. 1 is a fragmentary longitudinal cross-sectional view of an obsolete revolver of the type considered, provided with the new safety device, the mechanism being in its firing position (the cartridge being not shown, for simplicity);

FIG. 2 is an enlarged side view of the cylinder shaft;

FIG. 3 is a cross-sectional view of the shaft, taken in the plane and shown in the direction indicated at III—III in FIG. 2;

FIG. 4 illustrates a detail of the device in the "FIRE" position and in fragmentary sectional view taken in the plane indicated at IV—IV in FIG. 1;

FIG. 5 illustrates the revolver of FIG. 1, in its "SAFE" position; and

FIG. 6 illustrates fragmentarily and in larger scale a detail of the hammer and of the cooperating portion of the shaft, in the "SAFE" position, and in sectional view taken in the plane indicated at VI—VI in FIG. 4.

DETAILED DESCRIPTION OF THE PREFERRED EMBODIMENT

Referring now to the drawings, wherein like reference numerals refer to like parts throughout the several FIGURES; in FIGS. 3 to 6 numeral 36 indicates a critical component of the invention, as positioned in the "FIRE" position of the firearm, and 36*a* indicates (in phantom lines) the same component, but positioned for setting the firearm at "SAFE".

In the embodiment shown, the new device is associated with a typical revolver as constructed in the second half of the XIX Century (or with modern but exact replica thereof). The revolver includes a conventional cylinder 14 rotatably supported in a revolver frame 10, having a rear breech forming portion 30. A tapered opening is bored in said breech portion 30 for passage of the pointed fore part of the firing pin 28 which is associated with the hammer, generally indicated at 18 (and which will be described in detail below) for striking on the primer (not shown) of the cartridge which, in the cylinder 14, is actually aligned with the barrel 12 of the firearm.

The revolver comprises further a trigger 24, pivotally supported in the revolver frame, and having a nearly pointed upper end portion 26, designed to engage any of various notches or steps provided ebout the lower and approximately rounded portion of the hammer 18.

The operation of this mechanism is well known and will therefore not be described in detail. It is however to be noted that the actual firing of the revolver requires that the hammer 18, upon action on the trigger 26, will complete its full stroke under the force provided by the hammer spring 22, by rotating clockwise (in the position shown in FIG. 1) until the firing pin will strike the cartridge primer. The safety device is designed for positively preventing the hammer from completing its rotation about the axis of the hammer pin.

The cylinder 14 is supported within the frame 10 by a shaft 16 having a fore and a rear portion seated into a bore provided in the frame fore portion and respectively frame rear portion. The shaft 16 is secured in one predetermined axial position by a pin latch 32 engaging a notch 32*a* (the notches 32*a* and 32*b* will be described below). A fore extension 34 of the shaft 16, forwardly jutting out from the frame 10, is conventionally provided for complete removal of the shaft 16, when the removal of cylinder 14 is desired. In the device of the invention, the same extension 34 is made use of for manually rotating the shaft for setting the revolver at either of its "SAFE" or "FIRE" positions and conditions.

The same shaft 16 has a rear extension 36 rearwardly jutting out from the rear portion, of breech 30 of the frame. As shown in FIGS. 3 and 4 this extension is not co-axial with the shaft but sharply off-axis thereto. The hammer body 18 (which, when the revolver is fired, is conventionally well adjacent to the breech 30) has a recess 38 formed thereinto in such position that the extension 36 can enter in such recess only if said shaft is being rotated in one given rotational position.

In the specific structure shown in FIGS. 4 and 6, the recess 38 is asymmetrical relatively to the hammer (and entire firearm) plane of symmetry, containing the axes of the shaft 16 and of the barrel 12.

This combination of off-axis extension 36 and of recess 38 leads to the fact that when the shaft is correctly positioned in its predetermined rotational "FIRE" position (FIGS. 3 and 4) relatively to the hammer, and the preliminarily cocked hammer is conventionally triggered, the revolver will fire because the extension 36 does not prevent the full stroke of the hammer (to the position of FIG. 1), the said extension freely seating into the recess.

On the contrary, if the shaft is rotationally positioned in a different position, the extension 36 will abut on the hammer body and prevent such hammer from rotating clockwise more than the abutment position, such as the position shown in FIG. 5. Such rotational position sets the revolver at "SAFE".

The safety is improved upon rotating the shaft 180° from the described "FIRE" position, such as in the position indicated at 36*a* and shown in phantom lines in FIGS. 3 and 4, for abutment on a positively not recessed part of the hammer, and by providing means for allowing the shaft to be set only in either of said "SAFE" or "FIRE" positions. Such means can consists of the said latch pin 32 and said notches 32*a* and 32*b*.

Both said notches are made by tangentially machining the shaft at opposite locations of its cylindrical surface. In other words, said notches form recesses which are geometrically secant, in the same transversal plane, of the cylinder defined by same shaft 16. Therefore, the engagement of the latch pin 32 in either of the notches 32*a* or 32*b* provides (*i*) the securing of the shaft in one single predetermined axial position relatively to the revolver frame and hammer and one respective given rotational position wherefrom the shaft cannot be rotated, except upon exertion of a wanted positive action on the latch pin, or other suitable latching device adapted for firmly securing the shaft 16 in the selected both axial and rotational positions, principally for preventing such shaft from being axially displaced under the most violent shock exerted by and/or on the hammer.

The said notches 32*a* and 32*b* and the said extension 36 of the shaft are arranged, relatively to the recess 38 formed in the hammer, so that when the pin 32 is firmly engagement in the notch 32*a*, the extension 36 will face the recess 38, whereby the hammer will not be blocked in its full stroke and will reach its striking position of FIG. 1, for firing the revolver which, consequently is at its "FIRE" condition. When the shaft has been rotated by the gunman 180° and the latch pin firmly engages into the notch 32*b*, the shaft 16 will be axially and rotatively so locked in such position that the extension occupies the position indicated at 36*a* facing a not recessed part of the hammer. The shaft and the hammer cannot therefore be moved towards a position further than that shown in FIG. 6. The revolver is consequently set at "SAFE", ensuring the most complete safety.

What is claimed is:

1. An obsolete firearm of the revolver type including a cylinder mounted for rotation about an axially locked cylinder shaft in a frame having a breech forming rear portion and a trigger actuated hammer positioned at the rear of said breech portion and designed for reaching a striking position closedly adjacent to said breech portion when the firearm is fired, wherein the shaft is firmly associated with gunman operatable locking means for selectively locking it at either of two different rotational positions, the said shaft has a rear end portion having a rearwardly directed extension off-set of the shaft axis and rearwardly jutting out from said breech portion and facing the hammer, and the said hammer has a recess turned towards said extension and so positioned that when said shaft is locked in one of its said two rotational positions the said extension can freely enter in said recess when the hammer is triggered for firing, while when the same shaft is locked at the other of its said positions the said extension abuts on a not recessed part of the hammer preventing said hammer from completing its full and firing stroke.

2. The firearm as set forth in claim 1, wherein the locking means associated with the cylinder shaft is arranged for selectively locking said shaft in either of two rotational positions spaced at 180° from each other.

3. The firearm as claimed in claim 2, wherein the said extension and the said recess are positioned at one side of the firearm plane of symmetry containing the axis of the cylinder, and the said hammer is not recessed at the other side of said plane.

4. The firearm as set forth in claim 1, wherein the said gunman operatable locking means comprise two differently turned notches secantly formed about the cylinder shaft at one trasversal plane thereof and gunman operatable latch means connected to said frame for selectively engaging either of said notches for both axially and rotatively locking said shaft in a selected one of said two different positions.

5. The firearm of claim 4, wherein said latch means comprise a latch pin arranged in said frame for selectively engaging either one of said notches.

* * * * *